US010988894B2

(12) United States Patent
Kim et al.

(10) Patent No.: US 10,988,894 B2
(45) **Date of Patent: *Apr. 27, 2021**

(54) CLOTHES TREATMENT APPARATUS HAVING HEAT PUMP MODULE

(71) Applicant: LG ELECTRONICS INC., Seoul (KR)

(72) Inventors: Myoungjong Kim, Seoul (KR); Seongwoo An, Seoul (KR); Sangho Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 35 days.

This patent is subject to a terminal disclaimer.

(21) Appl. No.: 16/408,674

(22) Filed: May 10, 2019

(65) Prior Publication Data

US 2019/0264379 A1 Aug. 29, 2019

Related U.S. Application Data

(63) Continuation of application No. 15/397,975, filed on Jan. 4, 2017, now Pat. No. 10,344,424.

(30) Foreign Application Priority Data

Jan. 5, 2016 (KR) ..... 10-2016-0001190

(51) Int. Cl.
*D06F 58/20* (2006.01)
*D06F 37/22* (2006.01)
(Continued)

(52) U.S. Cl.
CPC ..... *D06F 58/206* (2013.01); *D06F 37/22* (2013.01); *D06F 39/04* (2013.01); *D06F 58/02* (2013.01);
(Continued)

(58) Field of Classification Search
CPC ..... D06F 58/206; D06F 37/22; D06F 39/04; D06F 58/24; D06F 25/00; D06F 39/12; D06F 58/20; D06F 58/02
(Continued)

(56) References Cited

U.S. PATENT DOCUMENTS 4,603,489 A * 8/1986 Goldberg ..... D06F 58/02 34/605
4,621,438 A ‡ 11/1986 Lanciaux ..... D06F 58/04 34/242
(Continued)

FOREIGN PATENT DOCUMENTS

CN 102108629 6/2011
CN 104233735 12/2014
(Continued)

OTHER PUBLICATIONS

International Search Report dated Feb. 17, 2017 issued in Application No. PCT/KR2016/012802.
(Continued)

*Primary Examiner* — Stephen M Gravini
(74) *Attorney, Agent, or Firm* — Ked & Associates LLP

(57) ABSTRACT

A clothes treatment apparatus includes a cabinet; a tub provided within the cabinet; a drum rotatably provided within the tub and configured to accommodate the laundry or a dry item therein; and a heat pump configured to circulate a refrigerant through a compressor, a condenser, an expansion valve, and an evaporator, and re-circulate air discharged from the drum to the drum by way of the evaporator and the condenser, wherein the heat pump includes a compressor base supporting and disposed above the tub, a bracket disposed in an upper portion of the compressor base, fixed to an upper surface of the compressor, and transmitting vibration generated by the compressor, and an air-vibration mount disposed between the bracket and the compressor
(Continued)

base and absorbing vibration of the compressor transmitted through the bracket.

19 Claims, 11 Drawing Sheets

(51) Int. Cl.
*D06F 39/04* (2006.01)
*D06F 58/02* (2006.01)
*D06F 58/24* (2006.01)
*D06F 25/00* (2006.01)
*D06F 39/12* (2006.01)

(52) U.S. Cl.
CPC ..... *D06F 58/24* (2013.01); *D06F 25/00* (2013.01); *D06F 39/12* (2013.01); *D06F 58/20* (2013.01)

(58) Field of Classification Search
USPC ..... 34/131, 595–610
See application file for complete search history.

(56) References Cited

U.S. PATENT DOCUMENTS

| | | | | |
|---|---|---|---|---|
| 5,131,169 | A * | 7/1992 | Jaster | D06F 58/02 34/398 |
| 6,234,445 | B1 | 5/2001 | Yoon | |
| 6,585,781 | B1 * | 7/2003 | Roseen | D06F 39/008 68/18 C |
| 7,073,273 | B2 * | 7/2006 | Kim | D06F 58/20 34/595 |
| 7,866,061 | B2 ‡ | 1/2011 | Tatsumi | D06F 58/206 34/134 |
| 8,112,904 | B2 ‡ | 2/2012 | Kono | D06F 25/00 34/201 |
| 8,418,378 | B2 * | 4/2013 | Nawrot | D06F 58/206 34/486 |
| 8,528,227 | B2 ‡ | 9/2013 | Beers | F26B 21/086 34/493 |
| 8,533,975 | B2 ‡ | 9/2013 | Beers | D06F 58/206 165/11.1 |
| 8,572,865 | B2 * | 11/2013 | Beers | D06F 58/04 34/601 |
| 8,595,953 | B2 ‡ | 12/2013 | Lee | D06F 58/206 34/413 |
| 8,595,954 | B2 ‡ | 12/2013 | Lee | D06F 58/206 34/487 |
| 8,601,717 | B2 ‡ | 12/2013 | Beers | D06F 58/206 137/597 |
| 8,863,400 | B2 ‡ | 10/2014 | Ahn | D06F 58/02 34/134 |
| 9,134,068 | B2 * | 9/2015 | Choi | D06F 58/22 |
| 9,207,015 | B2 * | 12/2015 | Ahn | D06F 58/02 |
| 9,212,441 | B2 ‡ | 12/2015 | Bison | D06F 25/00 |
| 9,255,732 | B2 ‡ | 2/2016 | Shu | D06F 58/206 |
| 9,356,542 | B2 * | 5/2016 | Ragogna | D06F 58/206 |
| 9,488,412 | B2 * | 11/2016 | Yu | D06F 58/24 |
| 9,506,185 | B2 * | 11/2016 | Choi | D06F 58/24 |
| 9,512,549 | B2 * | 12/2016 | Im | D06F 15/00 |
| 9,657,430 | B2 ‡ | 5/2017 | Lee | D06F 58/206 |
| 9,683,325 | B2 * | 6/2017 | Kim | D06F 58/24 |
| 10,273,628 | B2 * | 4/2019 | Je | D06F 58/22 |
| 10,344,424 | B2 * | 7/2019 | Kim | D06F 39/04 |
| 10,648,125 | B2 * | 5/2020 | Masters | D06F 58/24 |
| 10,676,859 | B2 * | 6/2020 | Vitali | D06F 58/30 |
| 10,711,386 | B2 * | 7/2020 | Jang | D06F 37/42 |
| 10,724,169 | B2 * | 7/2020 | Vian | D06F 39/04 |
| 2011/0036556 | A1 ‡ | 2/2011 | Bison | D06F 58/206 165/287 |
| 2011/0277334 | A1 ‡ | 11/2011 | Lee | D06F 58/203 34/73 |
| 2012/0159800 | A1 ‡ | 6/2012 | Del Pos | D06F 58/04 34/74 |
| 2014/0020260 | A1 ‡ | 1/2014 | Carow | D06F 58/206 34/427 |
| 2014/0208603 | A1 ‡ | 7/2014 | Kim | D06F 58/26 34/79 |
| 2014/0208609 | A1 | 7/2014 | Han et al. | |
| 2015/0322610 | A1 | 11/2015 | Garlatti et al. | |
| 2015/0345072 | A1 | 12/2015 | Ko et al. | |
| 2017/0191213 | A1 ‡ | 7/2017 | Kim | D06F 37/22 |
| 2018/0030644 | A1 ‡ | 2/2018 | Hong | D06F 58/02 |
| 2018/0080169 | A1 ‡ | 3/2018 | Je | D06F 58/22 |
| 2019/0264379 | A1 * | 8/2019 | Kim | D06F 58/02 |
| 2020/0024794 | A1 * | 1/2020 | Pattarello | D06F 58/30 |
| 2020/0048816 | A1 * | 2/2020 | Kim | D06F 58/26 |
| 2020/0141048 | A1 * | 5/2020 | Kang | D06F 58/206 |
| 2020/0224358 | A1 * | 7/2020 | Masters | D06F 58/30 |

FOREIGN PATENT DOCUMENTS

| | | | | |
|---|---|---|---|---|
| CN | 203978757 | | 12/2014 | |
| CN | 105544143 | | 5/2016 | |
| EP | 2 281 934 | | 2/2011 | |
| EP | 2 339 063 | | 6/2011 | |
| EP | 2 341 179 | | 7/2011 | |
| EP | 2 636 788 | | 9/2013 | |
| EP | 2990524 | A1 * | 3/2016 | D06F 58/206 |
| EP | 3 015 590 | | 5/2016 | |
| EP | 3 031 975 | | 6/2016 | |
| EP | 3031975 | A1 ‡ | 6/2016 | D06F 58/206 |
| EP | 2 622 121 | | 3/2017 | |
| EP | 2622121 | B1 ‡ | 3/2017 | D06F 58/206 |
| EP | 2 617 887 | | 7/2017 | |
| EP | 2617887 | A4 ‡ | 7/2017 | D06F 58/206 |
| EP | 3564428 | A1 * | 11/2019 | D06F 58/02 |
| JP | 05-099553 | | 4/1993 | |
| JP | 2006-129908 | | 5/2006 | |
| JP | 2010-063693 | | 3/2010 | |
| JP | 2011-000141 | | 1/2011 | |
| JP | 2011-167223 | | 9/2011 | |
| JP | 2012-095718 | | 5/2012 | |
| JP | 2013-052067 | | 3/2013 | |
| KR | 10-2014-0065265 | | 5/2014 | |
| KR | 10-2014-0147026 | | 12/2014 | |
| RU | 2 563 183 | | 9/2015 | |
| WO | WO 2012/034434 | | 3/2012 | |
| WO | WO 2012034434 | A1 ‡ | 3/2012 | D06F 58/206 |
| WO | WO 2012/044038 | | 4/2012 | |
| WO | WO 2012044038 | A2 ‡ | 4/2012 | D06F 58/206 |
| WO | WO 2012044038 | A3 ‡ | 7/2012 | D06F 58/206 |
| WO | WO 2014/083503 | | 6/2014 | |
| WO | WO 2015/068934 | | 5/2015 | |
| WO | WO-2016030149 | A1 * | 3/2016 | D06F 58/206 |
| WO | WO-2016080788 | A1 * | 5/2016 | D06F 58/20 |
| WO | WO 2017/119587 | | 7/2017 | |
| WO | WO 2017119587 | A1 ‡ | 7/2017 | D06F 37/22 |
| WO | WO-2017119587 | A1 * | 7/2017 | D06F 58/206 |

OTHER PUBLICATIONS

European Search Report dated Mar. 13, 2017 issued in Application No. 16 20 4924.1.
Chinese Office Action (with English translation) dated Aug. 16, 2018 issued in CN Application No. 201611151064.7.
Russian Notice of Allowance (with English translation) dated Oct. 30, 2018 issued in RU Application No. 2018128387.
U.S. Updated Notice of Allowability dated May 22, 2019 issued in U.S. Appl. No. 15/397,975.
Japanese Office Action dated Sep. 3, 2019 issued in JP Application No. 2018-533212.
Australian Office Action dated Jan. 22, 2020 issued in AU Application No. 2019200548.

* cited by examiner
‡ imported from a related application

CLOTHES TREATMENT APPARATUS HAVING HEAT PUMP MODULE

CROSS-REFERENCE TO RELATED APPLICATIONS

This is a Continuation Application of U.S. application Ser. No. 15/397,975 filed Jan. 4, 2017, which, pursuant to 35 U.S.C. § 119(a), claims the benefit of earlier filing date and right of priority to Korean Application No. 10-2016-0001190, filed on Jan. 5, 2016, the contents of each of which is incorporated by reference herein in its entirety.

BACKGROUND

1. Field

The present disclosure relates to a clothes treatment apparatus in which hot air is supplied to an interior of a drum using a heat pump.

2. Background

A clothes treatment apparatus may refer to a washing machine performing a function of washing clothes, a dryer performing a function of drying washed clothes, or a washer/drier performing both washing and drying function. Recently, clothes treatment apparatuses including a steam generating device supporting a refresh function such as removing wrinkles, odor, static electricity of clothes, or a sterilization function have been developed.

In general, a clothes treatment apparatus including a dry function may include a hot air supply unit supplying hot air to the laundry introduced to a clothes accommodation unit such as a drum, or the like, and dry the laundry, while evaporating moisture of the laundry. The hot air supply unit may be classified into a gas type heater, an electric heater, or a heat pump system according to heat source for heating air.

The heat pump system may apply heat to air discharged from a drum using a refrigerant circulating a compressor, a condenser, an expansion valve, and an evaporator and subsequently supply heat to the drum again. Compared with the gas type heater or the electric heater, the heat pump system may have excellent energy efficiency, and thus, research into ways for applying the heat pump system to a hot air supply unit of a heat treatment apparatus has been actively conducted.

Among clothes treatment apparatuses, a drum type of washing and drying machine may include a tub provided within a hexahedral cabinet and a drum rotatably provided within the tub. Compared with other internal components of the cabinet, the tub (or drum), having a cylindrical shape, may be so large in volume that it occupies a majority of an internal space of the cabinet. For example, an outer circumferential portion of the tub may be close to left and right side surfaces, upper or lower surface of the cabinet.

In order to apply the heat pump system to the drum type washing and drying machine, a heat pump system such as a compressor, a condenser, and an evaporator may be provided in a space excluding a space occupied by the tub (including drum) within the cabinet, specifically, in a space above the tub, a space below the tub, or a space between corners on the side of the cabinet above the tub. When the heat pump system is applied to the related art clothes treatment apparatus, since a compressor is voluminous and generates vibration and noise, the compressor may generally be disposed in a space between the tub and a lower surface of the cabinet.

However, in applying the heat pump system to the related art clothes treatment apparatus, when heat exchangers such as the evaporator and the condenser are positioned above the tub and the compressor is positioned below the tub, the following problems may arise. First, when the compressor and heat exchangers are separately positioned, it may be difficult to assemble the compressor and the heat exchangers.

Second, in the related art clothes treatment apparatus, since the compressor and the heat exchangers are separated from one another, it may be impossible to inspect a performance of the heat pump system before the compressor and the heat exchangers are assembled as a complete product. If a performance defect problem of the heat pump arises due to leakage of a refrigerant, or the like, the compressor and the heat exchangers should be disassembled, a corresponding defective part should be replaced, and the compressor and the heat exchanges may be re-assembled.

Third, when the compressor and the heat exchanger are positioned away from each other, a connection pipe between the compressor and the evaporator and a connection pipe between the compressor and the condenser extend, which may cause energy loss. Patent documents D1 (dryer) and D2 (drum type of washing and drying machine) as related arts of the present disclosure disclose a clothes treatment apparatuses employing a heat pump system.

FIG. 10 is a view illustrating a structure in which a heat pump system 30 is disposed above a tub 2 in a dryer of the related art Patent document D1. In the heat pump system 30, air discharged from the center above the tub 2 may be intaken by an intake fan 9, pass through an evaporator 34 and a condenser 32, heat exchanged with a refrigerant, and subsequently supplied again to a drum 3. A compressor 31 may receive a gaseous refrigerant from the evaporator 34, compress the refrigerant to have a high temperature and high pressure, and supply the compressed refrigerant to the condenser 32.

In D1, the tub 2 may be downwardly sloped at about 30 degrees toward areas of a cabinet 1, and thus, a rear space between the upper side of the tub 2 and a top cover 1*c* may be relatively large so that a vertical compressor 31 may extended in a vertical direction. However, in D1, in a case in which a tilt angle of the tub 2 is less than 10 degrees or almost horizontal, the rear space between the upper side and the top cover 1*c* may be relatively reduced to be insufficient for installing a vertical compressor.

In addition, in D1, two holes may be formed in an upper central surface and rear surface of the tub 2, and the tub 2 and the heat exchangers 34 and 32 may be connected by ducts 581 and 582 through the holes. However, the two holes formed on the tub 2 may degrade rigidity of the tub 2. EP 2 339 063 A2 and EP 2 281 934 A1 are hereby incorporated by reference in their entirety.

The above references are incorporated by reference herein where appropriate for appropriate teachings of additional or alternative details, features and/or technical background.

BRIEF DESCRIPTION OF THE DRAWINGS

Embodiments will be described in detail with reference to the following drawings in which like reference numerals refer to like elements, and wherein.

DETAILED DESCRIPTION

Hereinafter, a clothes treatment apparatus including a heat pump module according to an embodiment of the present disclosure will be described in detail with reference to the accompanying drawings, in which like numbers refer to like elements throughout although the embodiments are different. As used herein, the singular forms "a", "an" and "the" are intended to include the plural forms as well, unless the context clearly indicates otherwise.

Figure 1A:
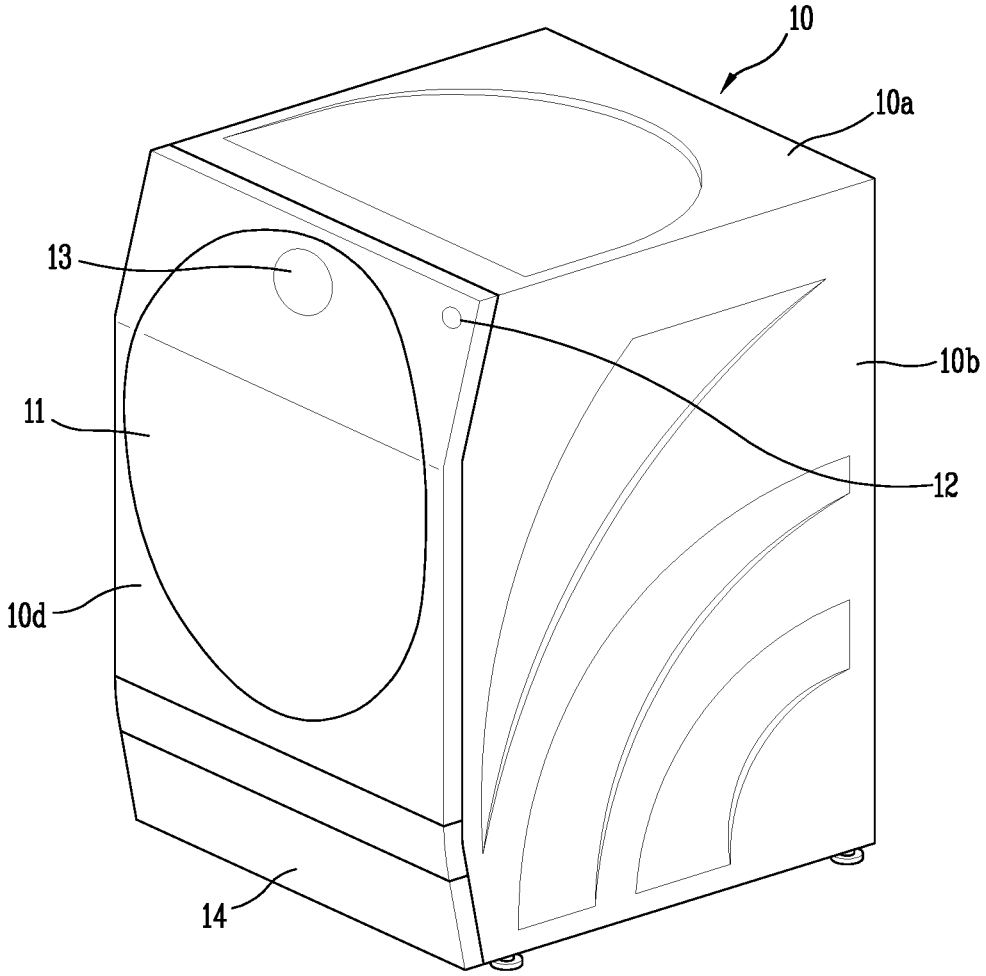
FIG. 1A is a perspective view illustrating an implementation example of a clothes treatment apparatus according to an embodiment of the present disclosure.

As illustrated in FIG. 1A, a cabinet 10 may form an external frame and an appearance of a clothes treatment apparatus. The cabinet 10 may have a hexahedral shape. The cabinet 10 may include a top cover 10*a* forming an upper surface of the hexahedron, a side cover 10*b* forming opposing sides of the hexahedron, a base cover 10*c* forming a lower surface of the hexahedron, a front cover 10*d* forming a front surface of the hexahedron, and a back cover 10*e* forming a rear surface of the hexahedron.

An opening for introducing the laundry such as clothes, or the like, may be formed on the front cover 10*d*, and a door 11 opening and closing the opening may be provided. The door 11 may be coupled to a front cover 10*d* by a hinge on a left side of the opening and a right side of the door 11 may be rotated in a forward/backward direction. An automatic releasing device to automatically release the button type door 11 may be provided on a right portion of the door 11 and on a right portion of the opening, so that when a right end portion of the door 11 may be pushed to be closed, the door 11 is locked, and when the closed door 11 is pressed once, the door 11 may be opened.

A power button 12 may be provided on a right upper end of the front cover 10*d* to turn on and off power of the clothes treatment apparatus. A display unit or display 13 and a touch type control panel may be formed on an upper end portion of the door 11. When a user performs a washing, spin-drying, or drying operation, an operational state of the clothes treatment apparatus may be visible to the user through the display unit 13. Various functions may be selected or selected functions may be released through the touch type control panel.

A detergent supply unit may be provided between a lower side of the tub 17 and the base cover 10*c* and may be drawn out or inserted in a drawer manner. A lower cover 14 may be rotatably provided below the front cover 10*d* in order to cover a front side of the detergent supply unit.

Figure 1B:
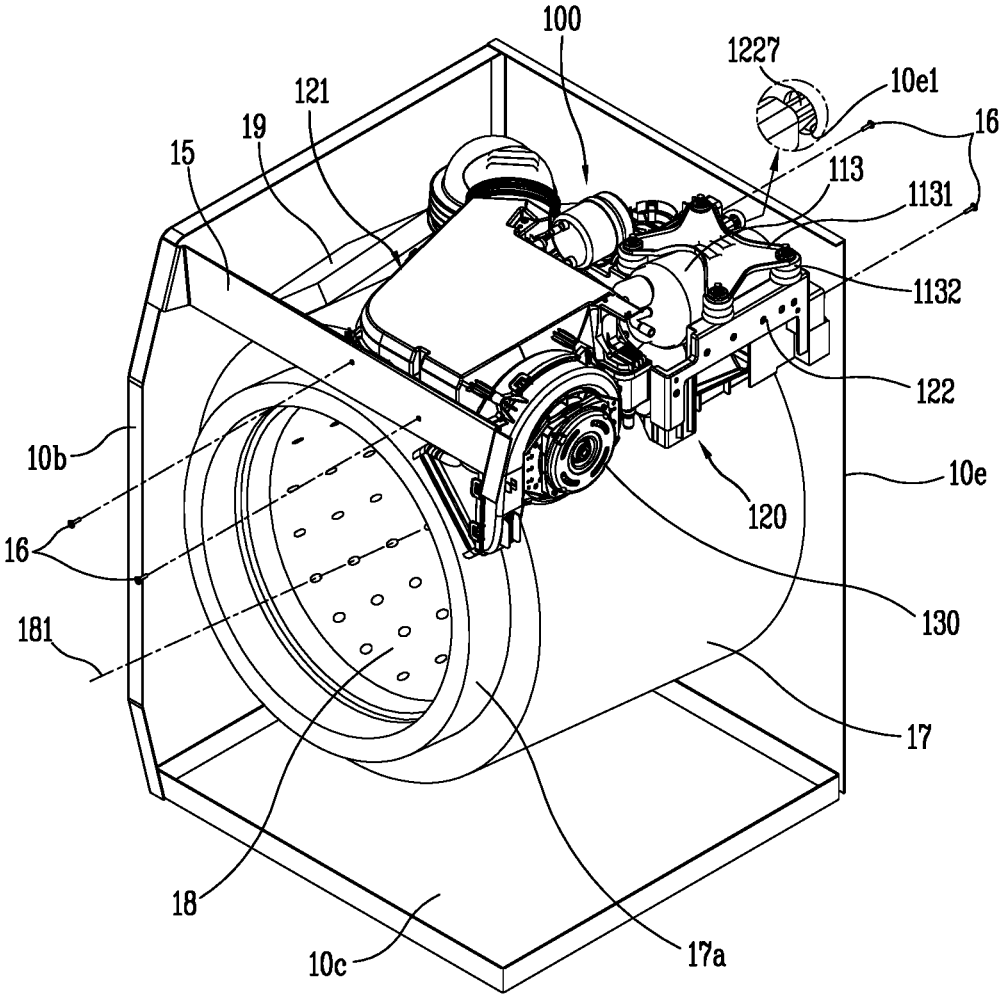
FIG. 1B is a perspective view illustrating a configuration in which a heat pump module is installed within a cabinet of FIG. 1A.

As illustrated in FIG. 1B, the tub 17 may be provided within the cabinet 10 and may store washing water. The tub 17 may have a cylindrical shape. An outer circumferential surface of the tub 17 may face the top cover 10*a*, the side cover 10*b*, and the base cover 10*c*. Also, an opening of the tub 17 may communicate with the opening of the front cover 10*d* to introduce the laundry on the front side of the tub 17. A rear side of the tub 17 may to face the back cover 10*e*. A gasket 17*a* may be formed on a front end portion of the tub 17 in a circumferential direction to prevent washing water kept in the tub 17 from leaking to the outside of the tub 17.

A cylindrical drum 18 may be rotatably provided within the tub 17 to provide an accommodation space for washing and drying the laundry. A plurality of through holes may be formed in the drum 18. Thus, when washing is performed, washing water supplied to the interior of the tub 17 may be introduced to the interior of the drum 18 to wet the laundry accommodated in the drum 18. Also, when drying is performed, hot air supplied to the interior of the tub 17 may be introduced to the interior of the drum 18 and supplied to the laundry within the drum 18 to evaporate moisture of the laundry to dry the laundry.

A heat pump module or heat pump 100 may be provided between the upper side of the tub 17 and the top cover 10*a*. The heat pump module 100 may include a compressor 113, an evaporator 111, a condenser 112, and an expansion valve 114. The evaporator 111, the compressor 113, the condenser 112, and the expansion valve 114 may be connected by a refrigerant pipe so that a refrigerant may circulate in order of the evaporator 111, the compressor 113, the condenser 112, the expansion valve 114, and the evaporator 111. Also, the tub 17, the evaporator 111, the condenser 112, and a circulation fan 130 may be connected to a heat exchange duct unit or heat exchange duct 121, and thus, air may circulate in order of the tub 17, the evaporator 111, the condenser 112, the circulation fan 130, and the tub 17.

Air and the refrigerant may circulate along independent movement paths such that air and the refrigerant may simply exchange heat with each other without being mixed with each other or coming into contact with each other. Air may circulate by way of the circulation fan 130, and the refrigerant may circulate by way of the compressor 113.

The refrigerant may absorb heat from a low temperature unit (evaporator 111) and emits the heat to a high temperature unit (condenser 112), thus transmitting the heat. The refrigerant compressed to have a high temperature and high pressure by the compressor 113 may emit the absorbed heat through the condenser 112.

The heat may be absorbed from air as air and the refrigerant are heat exchanged in the evaporator 111 when air discharged from the drum 18 passes through the evaporator 111. When air which has passed through the evaporator 111 passes through the condenser 112, air and the refrigerant may be heat exchanged in the condenser 112 to discharge air again.

In the heat pump module 100, the evaporator may absorb heat from air discharged from the drum 18 to thus condense and remove moisture from the air. Also, in the heat pump module 100, as the condenser 112 emits heat in the air, the heat pump module 100 may heat air to be re-supplied to the drum 18 to supply hot air to the drum 18.

In order to compactly install the evaporator 111, the condenser 112, the compressor 113, and the expansion valve 114 above the tub 17, the heat pump module 100 may use an integrated housing 120. The integrated housing 120 may include a heat exchange duct unit (or heat exchange duct) 121 accommodating the evaporator 111 and the condenser 112 therein and a compressor base unit (or compressor base) 122 supporting the compressor 113. The heat exchange duct unit 121 and the compressor base unit 122 may be formed as one body through injection molding, or the like.

The heat pump module 100 may be positioned above the tub 17 to protect the heat pump module 100 from water leakage. When washing water is supplied to the interior of the tub 17, water leakage may occur below the tub 17. Also, when the heat exchanger 110 is positioned below the tub 17 and leaked water is introduced to the heat exchanger 110, heat exchange efficiency may deteriorate to degrade performance of the heat pump. When the compressor 113 using electric energy as power is positioned below the tub 17, a short-circuit may occur due to water leakage.

When the compressor 113 is integrally modularized together with the evaporator 111 and the condenser 112 by the integrated housing 120 and installed above the tub 17, the following advantages may be obtained. First, an upper space of the tub 17 may be fully utilized. Second, assembling of the heat pump may be simplified. Third, performance inspection may be performed before a complete product is assembled. Fourth, a length of pipe may be shortened to reduce energy loss.

The heat pump module 100 may be supported by a front side and a rear side of the cabinet 10 in a forward/backward direction. A front frame 15 connecting a front upper end of the side cover 10*b* to a front side of the cabinet 10 may be provided, a front side of the integrated housing 120 may be fastened to the front frame 15 by a screw 16, and a rear side of the integrated housing 120 may be fastened to an upper end portion of the back cover 10*e* by the screw 16.

The heat exchange duct unit 121 may be provided on a front side of an upper portion of the tub 17, and the compressor base unit 122 may be provided on a rear side of an upper portion of the tub 17. The heat exchange duct unit 121 and the compressor base unit 122 may be arranged in a space between the upper side of the tub 17 and a side corner of the cabinet 10. The circulation fan 130 may be integrally installed on the right side of the heat exchange duct unit 121.

A left rear end portion of the heat exchange duct unit 121 may be connected to an air outlet on a rear side of an upper portion of the tub 17, and a right front end portion of the heat exchange duct unit 121 may be connected to the air inlet on a front side of an upper portion of the tub 17 (an upper portion of the gasket 17*a*), so that air discharged from the tub 17 may be re-supplied to the tub 17 again by way of the evaporator 111 and the condenser 112. Here, the circulation fan 130 may be provided on a downstream side of the condenser 112 to intake air discharged from the tub 17 to circulate air.

The integrated housing 120 may further include a vapor-liquid separator installation unit or mount 123 allowing a vapor-liquid separator 115 to be installed therein. The vapor-liquid separator 115 may be installed in a refrigerant pipe connecting the evaporator 111 and the compressor 113 to separate a liquid refrigerant which has not evaporated from the evaporator 111 from a vapor refrigerant and store the separated liquid refrigerant and transfer only the vapor refrigerant to the compressor 113. The vapor-liquid separator installation unit 123 may be positioned on a rear side above the tub 17. The vapor-liquid separator installation unit 123 may be integrally formed together with the heat exchange duct unit 122 and the compressor base unit 122.

The compressor base unit 122 and the heat exchange duct unit 121 may be separated. However, when the compressor base unit 122 and the heat exchange duct unit 121 are separated, the compressor base unit 122 and the heat exchange duct unit 121 may be positioned to be adjacent to each other. In a case in which the compressor base unit 122 is separated from the heat exchange duct unit 121, a connection member may be provided to support the font side and the rear side of the cabinet 10 in a forward/backward direction.

The compressor base unit 122 may have a protrusion rib 1227, so that when the compressor base unit 122 is fastened to the rear side of the cabinet 10 by the screw 16, an assembly position of the screw 16 may be easily found. The protrusion rib 1227 may protrude from the rear side of the compressor base unit 122, separately from a screw fixing portion of the compressor base unit 122. A guide hole 10*e*1 may be formed at an upper end portion of the back cover 10*e* to allow the protrusion rib 1227 to be inserted therein. The guide hole 10*e*1 may be spaced apart from a screw through hole through which the screw 16 penetrates through the back cover 10*e*. When protrusion rib 1227 is inserted into the guide hole 10*e*1, the screw 16 may be easily fastened to the screw fixing portion of the compressor base unit 122 through the screw through hole without having to look for an assembly position of the screw 16.

The heat exchange duct unit 121 may also have a protrusion 1217 and a protrusion rib 1217*a* which allow an assembly position of the screw 16 to be easily found when the heat exchange duct unit 121 is fastened to a front side of the cabinet 10 by the screw 16. A guide hole may be formed on the front frame 15 and as the protrusion 1217 and the protrusion rib 1217*a* are inserted into the guide hole, the screw 16 may be inserted through the screw through hole without having to look for an assembly position to easily fasten the heat exchange duct unit 121 to the front frame 15, a front side of the cabinet 10. The guide hole may be spaced apart from the screw through hole.

A control unit, or controller, may control a general operation of the clothes treatment apparatus, as well as the heat pump module 100. The control unit may include a PCB case having a flat rectangular box shape in which a height thereof is lower than a width and a length thereof, a PCB installed within the PCB case 19, and electric/electronic control components installed in the PCB.

Figure 1C:
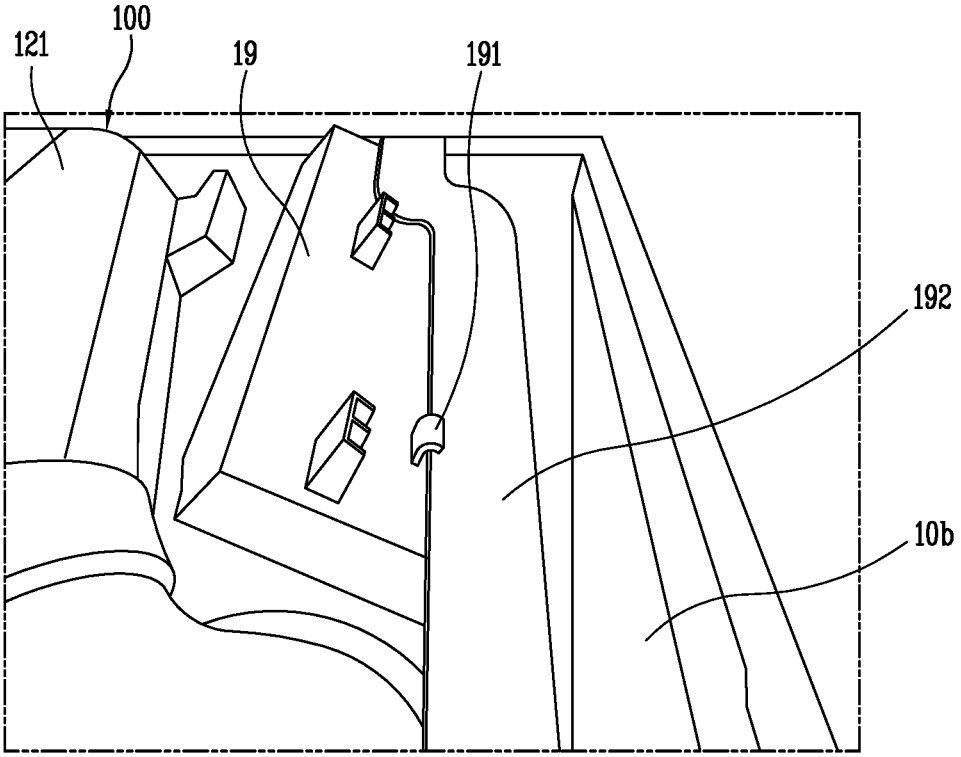
FIG. 1C is a rear perspective view illustrating a fixing structure of a PCB case of FIG. 1B.

FIG. 1C is a rear perspective view illustrating a fixing structure of a PCB case of FIG. 1B.

As illustrated in FIG. 1C, the PCB case 19 may be provided on a left side of the heat pump module 100 in a diagonal direction (when viewed from the front cover 10*d*) by using a space between the upper side of the tub 17 and the left side corner of the cabinet 10. A width of the PCB case 19 may be longer than a space between the center above the tub 17 and the left side cover 10*b*.

Thus, in order to avoid interference of the PCB case 19 with other components and compactly configure the PCB case 19 together with the heat pump module 100, the PCB case 19 may be provided in a downward direction of the left side from a central upper portion of the cabinet 10 when viewed from the front cover 10*d*. Here, the left side of the heat pump module 100 may be positioned between the central upper portion of the cabinet 10 and the upper side of the tub 17 and a space from the left side corner of the cabinet 10 in a downward direction may be larger than a space between the central upper portion of the cabinet 10 and the upper side of the tub 17. The PCB case 19 may be provided in a diagonal direction such that a right side thereof faces the left side of the heat pump module 100 and a left side of the PCB case 19 faces the left side cover 10*b* of the cabinet 10.

In order to stably support the PCB case 19 within the cabinet 10, the PCB case 19 may have a fixing protrusion 191 protruding from one side of an upper surface of the PCB case 19. An upper end portion of the fixing protrusion 191 may have a hook shape. Also, the cabinet 10 may have a fixing member 192 extending from one side of an upper end portion of the front cover 10*d* to one side of an upper end portion of the back cover 10*e* in order to support the PCB case 19. Since the upper end portion of the fixing protrusion 191 may be caught on the side surface of the fixing member 192, the PCB case 19 may be stably supported between the left side corner of the cabinet 10 and the heat pump module 100 and compactly installed.

The PCB case 19 may be electrically connected to the heat pump module 100, and thus, performance of the heat pump module 100 may be inspected in units of modules before a complete product of the clothes treatment apparatus is assembled. Since the PCB case 19 is connected to the heat pump module 100 for performance inspection of the heat pump module 100, the PCB case 19 may be positioned close to the heat pump module 100. Since the PCB case 19 is arranged in a diagonal direction to be close on the side surface of the heat pump module 100 and connected to the heat pump module 100, the PCB case 19 may be compactly installed within the cabinet 10 together with the heat pump module 100.

Figure 2:
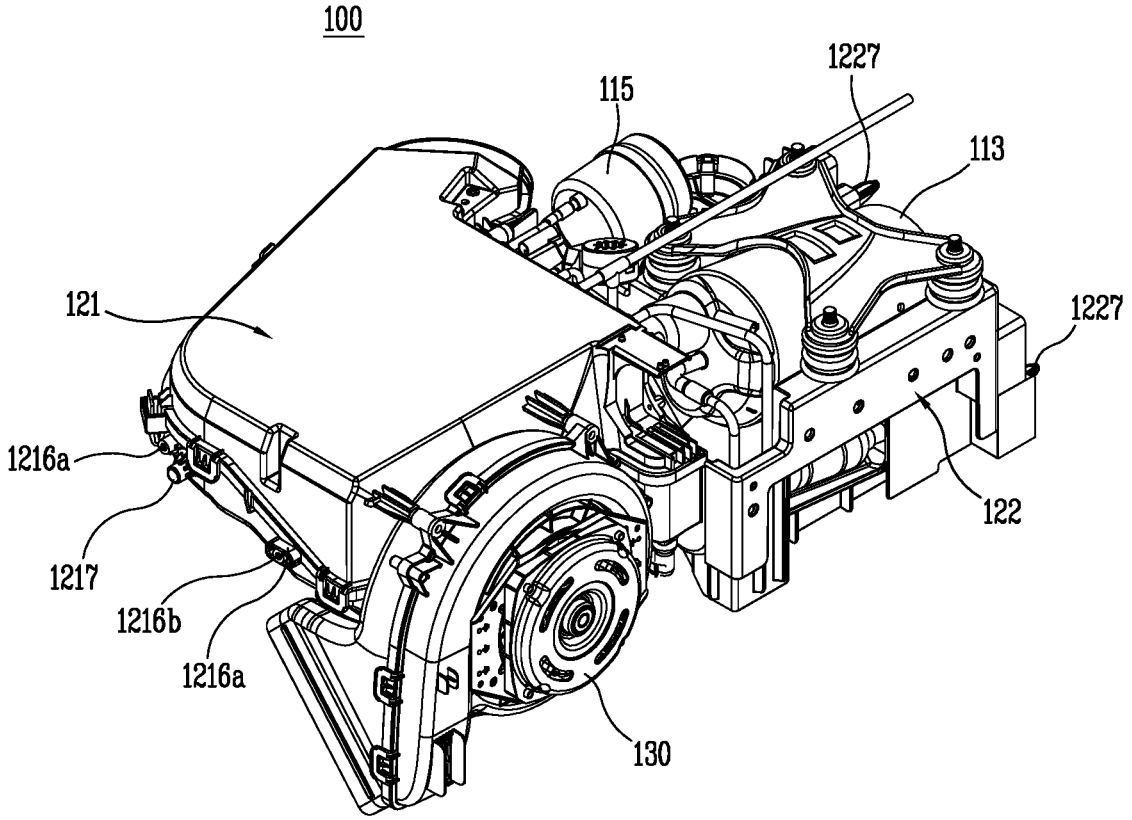
FIG. 2 is a perspective view illustrating a heat pump module of FIG. 1B.

As illustrated in FIG. 2, the compressor 113 may be installed in the compressor base unit 122, and the vapor-liquid separator 115 may be installed in the vapor-liquid separator installation unit 123. A pipe extending from the rear side of the heat exchange duct unit 121 toward an upper rear side of the compressor base unit 122 may be connected to a refrigerant pipe 110*a* of the heat exchanger 110 of the heat exchange duct unit 121 to make the refrigerant pipe 110*a* vacuumized and inject a refrigerant. After the refrigerant is injected, the refrigerant injection pipe may be sealed.

Two fastening portions 1216*a*, or screw fixing portions, may be provided on the front side of the heat exchange duct unit 121 illustrated in FIG. 2. The fastening portions 1216*a* may have a circular pipe shape, and as the screw 16 is fastened to the interior of the fastening portions 1216*a*, a front side of the heat exchange duct unit 121 may be supported by the front frame 15 of the cabinet 10.

The two fastening portions 1216*a* may be provided mutually in a diagonal direction on the front side of the heat exchange duct unit 121 to stably support the heat exchange duct unit 121. Also, since one of the two fastening portions 1213*a*' is surrounded by an oval fastening portion 1216*b* formed to have an oval pipe shape, strength may be reinforced.

Figure 3:
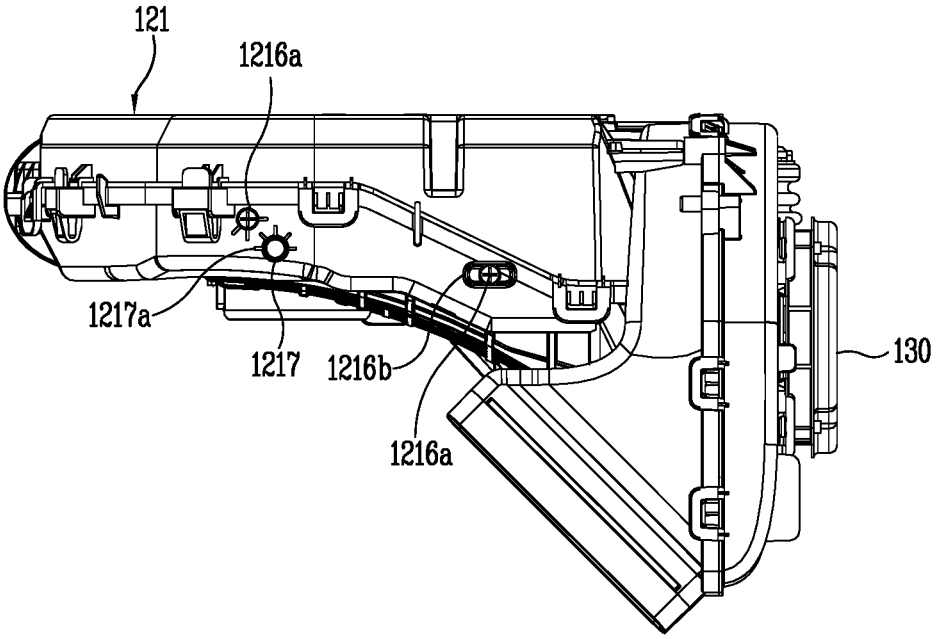
FIG. 3 is a front view of a heat exchanging duct unit of FIG. 2.

As illustrated in FIG. 3, a front side of the heat exchange duct unit 121 may also be a front side of the integrated housing 120. A lower surface of the heat exchange duct unit 121 may be rounded along an upper outer circumferential surface of the tub 17. This may fully utilize the upper space of the tub 17.

Referring to FIG. 3, the fastening portion 1216*a* having a circular pipe shape may protrude on the left of the heat exchange duct unit 121, and a reinforcing rib may protrude radially on an outer circumferential surface of the fastening portion 1216*a* to reinforce strength. Another fastening portion 1216*a* may be formed between the fastening portion 1216*a* and the circulation fan 130, and an oval fastening portion 1216*b* protruding in an oval tube shape to cover an outer side of the fastening portion 1216*a* may be further provided. The two fastening portions 1216*a* may be portions to which the screw 16 is fastened, and may support a front surface of the integrated housing 120 or the heat exchange duct unit 121.

A protrusion 1217 having a circular pipe shape may protrude in a right diagonal direction of the fastening portion 1216*a* positioned on the left of the heat exchange duct unit 121. The protrusion 1217 may properly position the screw 16 fixed to the fastening portion 1216*a* in an assembly position. A plurality of protrusion ribs 1217*a* may radially protrude along an outer circumferential surface of the protrusion 1217, and a rear end portion of each of the protrusion ribs 1217*a* may extend to a front side of the heat exchange duct unit 121 so as to be integrated. The protrusion 1217 may be inserted into a guide hole formed in the front frame 15 and temporarily fastened. Since the protrusion 1217 is inserted into the guide hole and temporarily fastened, the protrusion 1217 may guide the screw 16 to be fastened to a predetermined position before the integrated housing 120 is fastened to the front frame 15 by the screw 16.

The heat exchange duct unit 121 may be separated into two components including a duct body 121*a* and a duct cover 121*b*. By fastening a U-shaped fastening member formed in the duct cover 121*b* and a fastening rib formed in the duct body 121*a*, the two components may be integrally assembled.

Figure 4:
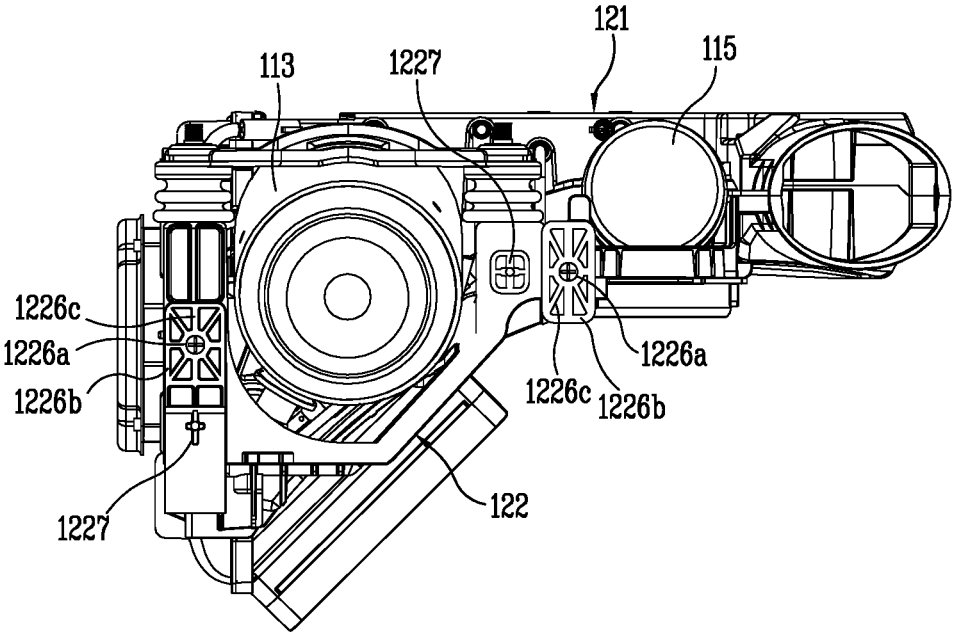
FIG. 4 is a rear view of a compressor base unit.

Referring to FIG. 4, a rear side of the compressor base unit 122 may also be a rear side of the integrated housing 120. The compressor 113 may be installed in the compressor base unit 122 on the left side of the drawing. Also, the vapor-liquid separator 115 may be installed in the vapor-liquid separator installation unit 123 on the right side.

A lower surface of the compressor base unit 122 may be rounded along an outer circumferential surface of the upper portion of the tub 17. This may help to fully utilize the upper space of the tub 17. Since the compressor 113 is relatively large in volume, a horizontal compressor 113 may be used instead of a vertical compressor. The horizontal compressor 113 may include a rotational shaft 113*d* is disposed in a horizontal direction. Also, the rotational shaft 113*d* of the horizontal compressor 113 provided to extend in a forward/backward direction of the cabinet 10. A front end portion of the horizontal compressor 113 is may face the heat exchange duct unit 121, and a rear end portion of the horizontal compressor 113 may face the back cover 10*e*. The horizontal compressor 113 according to an embodiment of the present disclosure may be installed such that a rear portion (compression mechanism unit 113*b*) of the compressor 113 is tilted to be lower with respect to a horizontal plane (or the top cover 10*e*).

At least two fastening portions 1226*a* having a circular pipe shape as screw fixing portions may be formed on the rear surface of the compressor base unit 122. The fastening portions 1226*a* having a circular pipe shape may further include a quadrangular fastening portion 1226*b* and a reinforcing rib 1226*c* in order to reinforce strength. The quadrangular fastening portion 1226*b* may have a size greater than a diameter of the circular fastening portion 1226*a* and may cover the circular fastening portion 1226*a* from the outside of the circular fastening portion 1226*a*.

A reinforcing rib 1226*c* may radially extend between the quadrangular fastening portion 1226*b* and the circular fastening portion 1213*a*' to reinforce strength of the circular fastening portion 1226*a*. Since the screw 16 is fastened to the fastening portion 1226*a* of the compressor base unit 122, a rear side of the compressor base unit 122 or the integrated housing 120 may be fixed to the back cover 10*e* so as to be supported.

A protrusion or a cross protrusion rib 1227 may protrude from a rear side of the compressor base unit 122. The protrusion rib 1227 may properly position the screw 16 fixed to the fastening portion 1226*a* in an assembly position. The protrusion rib 1227 may be inserted into the guide hole 10*e*1 formed in the back cover 10*e* so as to be temporarily fastened. Since the protrusion rib 1217 is inserted into the guide hole 10*e*1 and temporarily fastened, the screw 16 is may be fastened to a predetermined portion before the rear side of the compressor base unit 122 is fastened to the back cover 10*e* by the screw 16.

The compressor base unit 122 may be fastened to the back cover 10*e* through the fastening portion 1226*a*, the front side of the compressor base unit 122 may be integrally connected to the rear side of the heat exchange duct unit 121, and the heat exchange duct unit 121 may be fastened to the front frame 15 through the fastening portion 1216*a* described above, whereby a load of the compressor 113 may be supported. The compressor base unit 122 may be separated from the heat exchange duct unit 121. In this case, however, a connection member may need to be additionally provided to connect the compressor base unit 122 and the front side of the cabinet 10. The reason is because when the compressor base unit 122 is supported by the front side and the rear side of the cabinet, it may be stably fixed.

Figure 5:
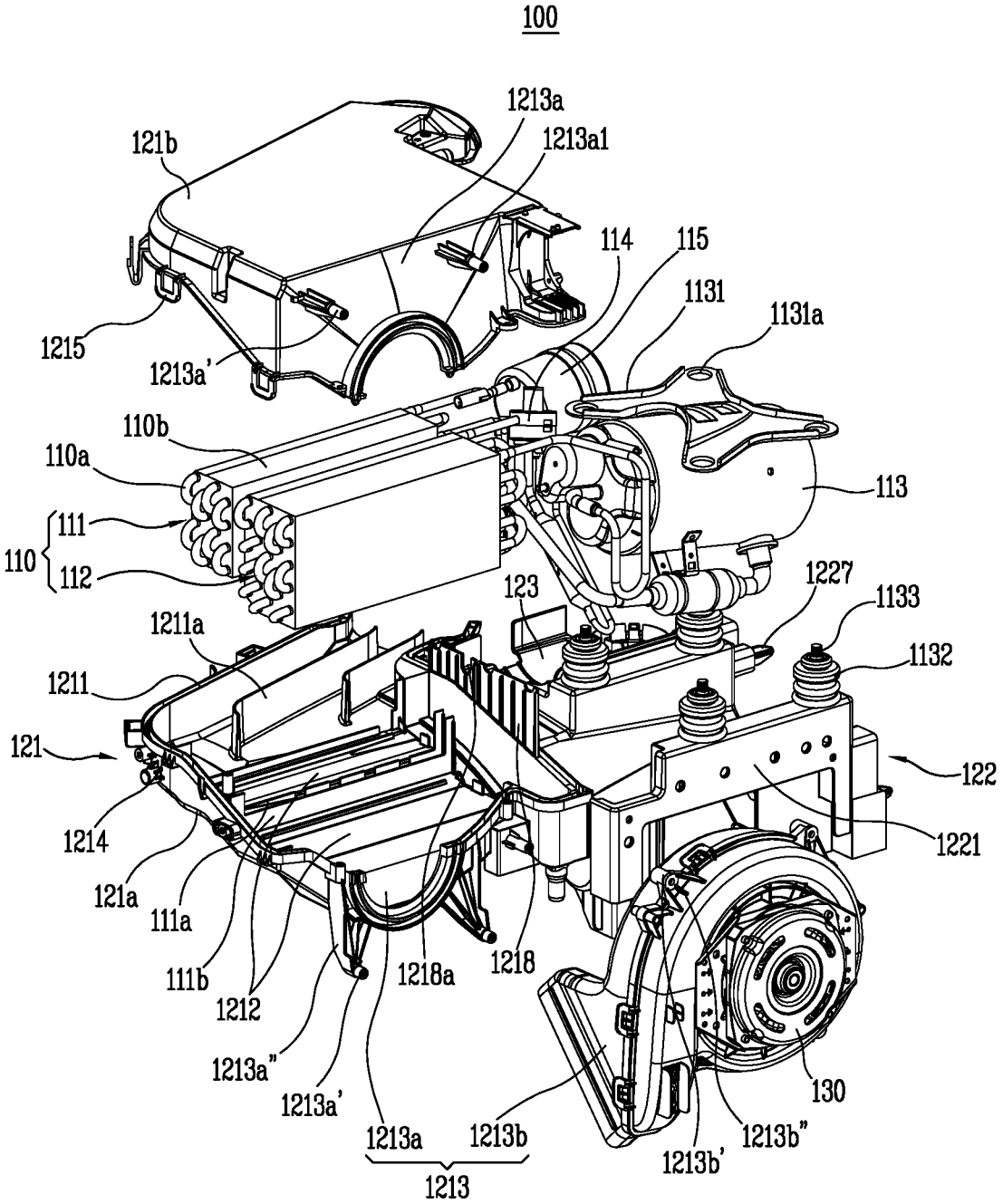
FIG. 5 is an exploded perspective view of the heat pump module of FIG. 2.

As illustrated in FIG. 5, the integrated housing 120 may include the heat exchange duct unit 121 accommodating the evaporator 111 and the condenser 112, and the compressor base unit 122 supporting the compressor 113. The evaporator 111 may remove moisture in the air and the condenser 112 may heat air. Since the evaporator 111 and the condenser 112 are similar in that they heat exchange a refrigerant and air, the evaporator 111 and the condenser 112 may include similar components.

For example, the evaporator 111 and the condenser may each include a heat transmission plate 110*b* and a refrigerant pipe 110*a*. The refrigerant pipe 110*a* may penetrate through the heat transmission plate 110*b*, and the heat transmission plates 110*b* may be arranged vertically and spaced apart from one another in a direction crossing an air flow direction to expand a heat exchange area.

The heat exchange duct unit 121 may communicate with an upper portion of the tub 17 to form a circulation flow path to circulate air. The heat exchange duct unit 121 may include a heat exchange installation portion or groove 1212, a first connection duct 1211, and a second connection duct 1213 according to functions. The evaporator 111 and the condenser 112 may be spaced apart from one another in a direction crossing a rotation central line 118 of the drum 18 within the heat exchange installation portion 1212. In the heat exchange duct unit 121, the evaporator 111 may be provided at an upstream side, and the condenser 112 may be provided at a downstream side. When the heat exchange duct unit 121 is viewed from the front cover 10*d*, the evaporator 111 may be provided on the left side and the condenser 112 may be provided on the right side.

The first connection duct 1211 may extend in a diagonal direction backwardly of an upper portion of the tub 17 on the left side of the heat exchange installation portion 1212 and may be connected to the air outlet of the tub 17, and air discharged from the tub 17 may be introduced to the evaporator 111. A plurality of air guides 1211*a* may be formed within the first connection duct 1211 to guide air discharged from the drum 18 to the evaporator 111.

The second connection duct 1213 may extend to the upper right and front side of the tub 17 from the right side of the heat exchange installation portion 1212 and may be connected to the air inlet of the tub 17, and air which has passed through the condenser 112 may be resupplied to the interior of the tub 17. A circulation fan 130 may be installed on the right side of the second connection duct 1213 to intake air discharged from the tub 17.

In order to install the circulation fan 130, the second connection duct 1213 may be separated into a duct unit connection duct 1213*a* and a fan connection duct 1213*b*. The duct unit connection duct 1213*a* may connect the heat exchange installation portion 1212 and the circulation fan 130, and a size of a cross-section of the duct unit connection duct 1213*a* may be reduced toward the circulation fan 130. In order to integrally connect the duct unit connection duct 1213*a* and the fan connection duct 1213*b*, a fastening portion or boss 1213*a*' may be formed on an outer surface of the duct unit connection duct 1213*a* forming a portion of the duct body 121*a* and the duct cover 121*b*.

A fastening portion or boss 1213*b*' may be provided on an outer circumferential surface of the fan connection duct 1213*b* such that the fastening portion 1213*b*' faces the fastening portion 1213*a*' of the duct unit connection duct 1213*a*. The fastening portion 1213*a*' of the duct unit connection duct 1213*a* and the fastening portion 1213*b*' of the fan connection duct 1213*b* may be fastened to each other by a screw. A reinforcing rib may be formed on an outer circumferential surface of the fastening portion 1213*a*' of the duct unit connection duct 1213*a* forming a portion of the duct cover 121*b* to reinforce bearing power of the fastening portion 1213*a*'.

The fastening portion 1213*b*' provided on the outer circumferential surface of the fan connection duct 1213*b* may be supported by a connection rib 1213*b*". The fan connection duct 1213*b* may cover the circulation fan 130 and extend vertically downwardly from one side of the circulation fan 130 so as to be connected to the gasket 17*a* of the tub 17. The fan connection duct 1213*b* may be configured as two components to accommodate the circulation fan 130 therein. The two fan connection duct 1213*b* components may each include a U-shaped fastening member or fastener 1215 and a fastening rib 1214 which may be detachably coupled to each other in a facing manner.

The heat exchange installation portion 1212 may be formed stepwise to increase heat exchange efficiency, while fully utilizing the upper space of the tub 17. For example, when the heat exchange duct unit 121 is rounded along the outer circumferential surface of the upper portion of the tub 17, a lower surface of the heat exchange installation portion 1212 may be lowered from the left side of the evaporator 111 toward the right side of the condenser 112, and as a result, a height of the right side space of the heat exchange installation portion 1212 may be increased. In this manner, when the increased space of the heat exchange installation portion 1212 is utilized, a size of the condenser 112 against the evaporator 111 may be increased to increase heating value emitted in the air through the condenser 112.

Accordingly, performance of the heat pump may be increased. Upper end portions f the evaporator 111 and the condenser 112 may be provided on the same horizontal plane, and lower end portions of the evaporator 111 and the condenser 112 may be provided on different planes. The height of the condenser 112 may further extend downwardly, compared with the evaporator 111, to increase a heat exchange area of the condenser 112 such that it is greater than a heat exchange area of the evaporator 111.

Two condensate carryover preventing protrusions 111*a* may be formed on a lower surface of the heat exchange installation portion 1212. In one of the two condensate carryover preventing protrusions 111*a*, condensate drain holes may be to be spaced apart from one another such that condensate generated by the evaporator 111 may flow to the lower surface of the evaporator 111 and drained. The other condensate carryover preventing protrusion 111*a* may prevent condensate to be discharged from a lower surface of the evaporator 111 from being discharged to the condenser 112. Since cohesive force of condensate is considerably higher than suction force of air, a height of the condensate carryover preventing protrusion 111 from the lower surface of the evaporator 111 may be less than ⅕ of the total height of the condenser 112.

The heat exchange duct unit 121 may have a sealing plate 1218 to maintain air-tightness between the heat exchange duct unit 121 and the refrigerant pipe 110*a* when the refrigerant pipe 110*a* of the heat exchange 110 extends to the outside of the heat exchange duct unit 121. For example, the sealing plate 1218 may protrude vertically from a lower surface of the rear side of the heat exchange installation portion 1212, a sealing hole 1218*a* may be formed on an upper portion of the sealing plate 1218 to allow the refrigerant pipe 110*a* to penetrate therethrough, and a sealing member such as an O-ring may be formed at the sealing hole 1218*a* to prevent leakage of air from the heat exchange duct unit 121 to the outside.

As the compressor 113 is positioned in the upper space of the tub 17, a support structure of the compressor 113 may need to be considered in the following two aspects. According to one aspect, a disposition space of the compressor 113 may need to be considered. As the compressor 113 is positioned in the upper space of the tub 17, the compressor may be restricted in space. In order to solve this problem, a horizontal compressor 113, which may be laid extendedly in a forward/backward direction of the tub 17 or in a direction toward the rotation central line 181 of the drum 18 in the side corner space of the cabinet 10 may be considered.

The horizontal compressor 113 may be a rotary compressor 113. The horizontal rotary compressor 113 may suck and compress a refrigerant gas, while a compression part 113*b* may eccentrically rotate using rotary force of a motor part 113*a*.

In order to minimize a disposition space of the horizontal compressor 113, an outlet 1134 of the compressor 113 may face the rear side of the heat exchange duct unit 121. An inlet of the compressor 113 may be formed on a lower surface of a compressor casing 113*c*.

According to another aspect, vibration and noise of the compressor 113 should be considered. As the compressor 113 is positioned in the upper space of the tub 17, it may be important to solve the vibration and noise problem of the compressor 113. In order to minimize vibration and noise of the compressor 113, a bracket 1131, an anti-vibration mount 1132, and a fastening bolt 1133 may be added to the compressor base unit 122.

The compressor base unit 122 may support a load of the compressor 113. The compressor base unit 122 may surround a lower surface and both side surfaces of the compressor casing 113*c* in a contact manner. When the compressor base unit 122 is viewed from the back cover 10*e*, the compressor base unit 122 may have a U-shaped cross-sectional shape.

A support 1221 may be formed vertically upwardly with the compressor casing 113*c* interposed therebetween on the lower surface of the compressor base unit 122. The support 1221 may support the bracket 1131 and the anti-vibration mount 1132. The support 1221 may have two fastening holes formed to penetrate therethrough in a vertical direction. The fastening holes may be spaced apart from one another in a forward/backward direction along a length of the support 1221.

The fastening bolt 1133 may be fastened from a lower portion of the support 1221 through the fastening hole of the support 1221 and the interior of the anti-vibration mount 1132. The anti-vibration mount 1132 may absorb vibration and noise. In order to absorb vibration, the anti-vibration mount 1132 may be formed of rubber. A structure of the anti-vibration mount 1132 will be described as follows.

Figure 6A:
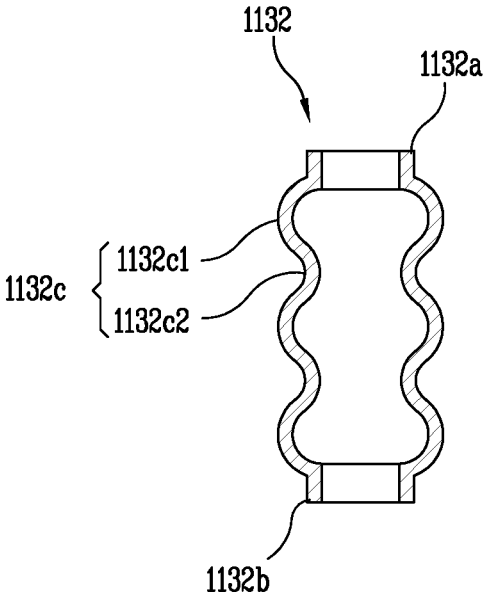
FIG. 6A is a cross-sectional view of an anti-vibration mount according to an implementation example of the present disclosure.

As illustrated in FIG. 6A, the anti-vibration mount 1132 may have a bellows tube shape. The anti-vibration mount 1132 may include an upper bonding portion 1132*a*, a lower bonding portion 1132*b*, and a connection portion 1132*c* according to functions and positions.

The upper bonding portion 1132*a* may be coupled to an edge portion of the bracket 1131. The lower bonding portion 1132*b* may be coupled to an upper surface of the support 1221.

The connection portion 1132*c* may connect the upper bonding portion 1132*a* and the lower bonding portion 1132*b*. The connection portion 1132*c* may have a bellows tube shape and may extend in a vertical direction between the upper bonding portion 1132*a* and the lower bonding portion 1132*b*. The bellows tube may have a hollow portion therein and have an extending portion 1132*c*1 in which a cross-section or diameter of the tube is increased and a reducing portion 1132*c*2 in which the cross-section or diameter of the tube is decreased. Here, the extending portion 1132*c*1 and the reducing portion 1132*c*2 may be alternately arranged in a vertical direction. The extending portion 1132*c*1 and the reducing portion 1132*c*2 may be rounded.

Figure 6B:
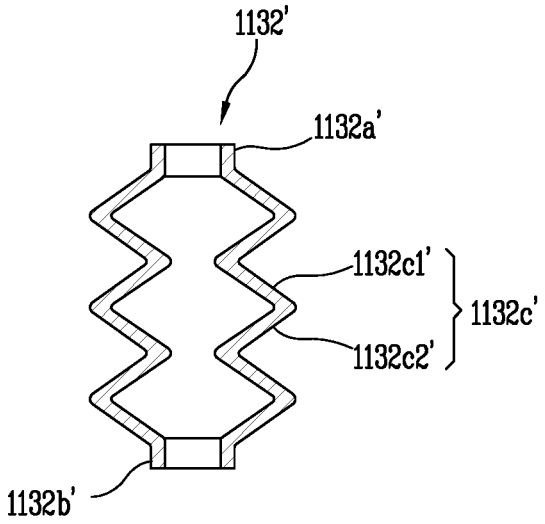
FIG. 6B is a cross-sectional view of an anti-vibration mount according to another implementation example of the present disclosure.

An anti-vibration mount 1132' illustrated in FIG. 6B may also have a bellows tube shape. A shape of a connection portion 1132*c*' may be different. The connection portion 1132*c*' illustrated in FIG. 6B may have an expanding portion 1132*c*1' and a reducing portion 1132*c*2' formed to be sloped at a predetermined tilt and alternately arranged in a gravitation direction. The expanding portion 1132*c*1' may have a cross-sectional area increased in a downward direction in relation to a directly downward direction (right under), and the reducing portion 1132*c*2' may have a cross-sectional area reduced in a downward direction in relation to the directly downward direction. However, the expanding portion 1132c1' and the reducing portion 1132c2' may be reversed in position in relation to a directly upward direction (right above).

The anti-vibration mounts 1132 and 1132' having a bellows tube shape may be formed of rubber with elasticity, allow a relative movement in a vertical direction, and absorb vibration in a vertical direction and horizontal direction. The bracket 1131 may be provided in an upper portion of the compressor base unit 122. The bracket 1132 may be formed of a plate member having an X shape.

The bracket 1131 may have a fixed portion formed in a central portion thereof and fixed to surround an outer circumferential surface of the compressor casing 113c. The fixed portion of the bracket 1131 may be convex in an upward direction and rounded to be in contact with the outer circumferential surface of the compressor casing 113c. Also, the fixed portion of the bracket 1131 may be fixed to two portions of a front side of the compressor casing 113c and one portion of a rear side of the compressor casing 113c in a length direction through welding. An edge portion of the bracket 1131 may extend in a diagonal direction from a central portion, and a fixing hole 1131a may be formed in each of corner portions of the bracket 1131.

The upper bonding portions 1132a of four anti-vibration mounts 1132 may be insertedly fixed to the fixing holes 1131a at the four corners of the bracket 1131. Also, the lower bonding portion 1132b of the anti-vibration mount 1132 may overlap a fastening hole position formed in an upper portion of the support 1221.

The fastening bolt 1133 may be insertedly fastened through a fastening hole in a vertical upward direction at a lower side of the support 1221. A head portion having a large diameter at a lower end portion of the fastening bolt 1133 may be inserted into the fastening hole of the support 1221 so as to be fixed to a lower portion of the support 1221, and a screw portion formed in an upper end portion of the fastening bolt 1133 may protrude sequentially through the fastening hole of the support 1221, the hollow portion of the anti-vibration mount 1132, and the fixed hole 1131a of the bracket 1131. As the screw portion of the fastening bolt 1133 protruding from the fixing hole 1131a is fastened to a nut, the bracket 1131 and the anti-vibration mount 1132 may be fixed to an upper portion of the support 1221.

Figure 7:
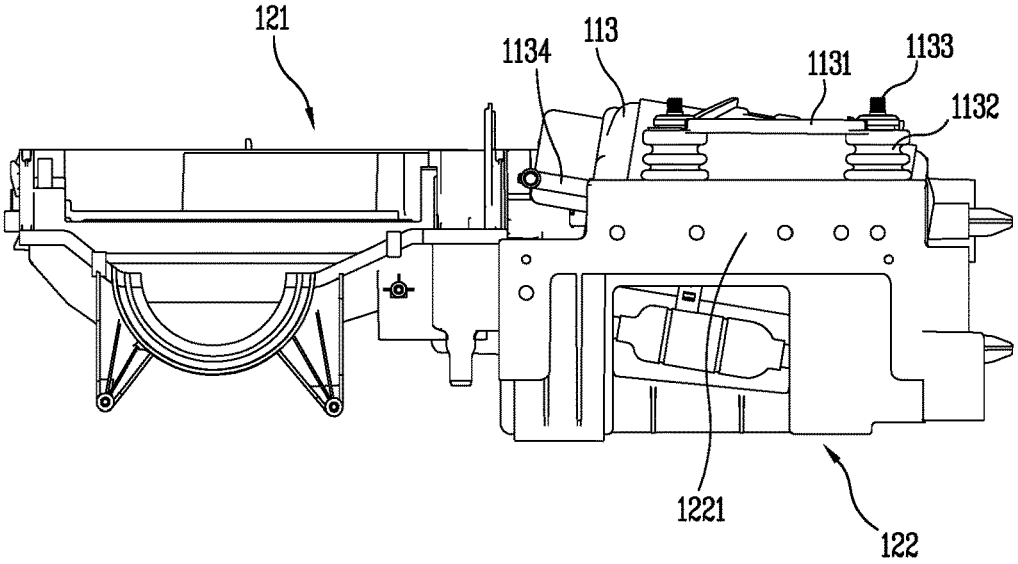
FIG. 7 is a side view illustrating a configuration in which a compressor is installed in a compressor base unit of FIG. 5.
Figure 8:
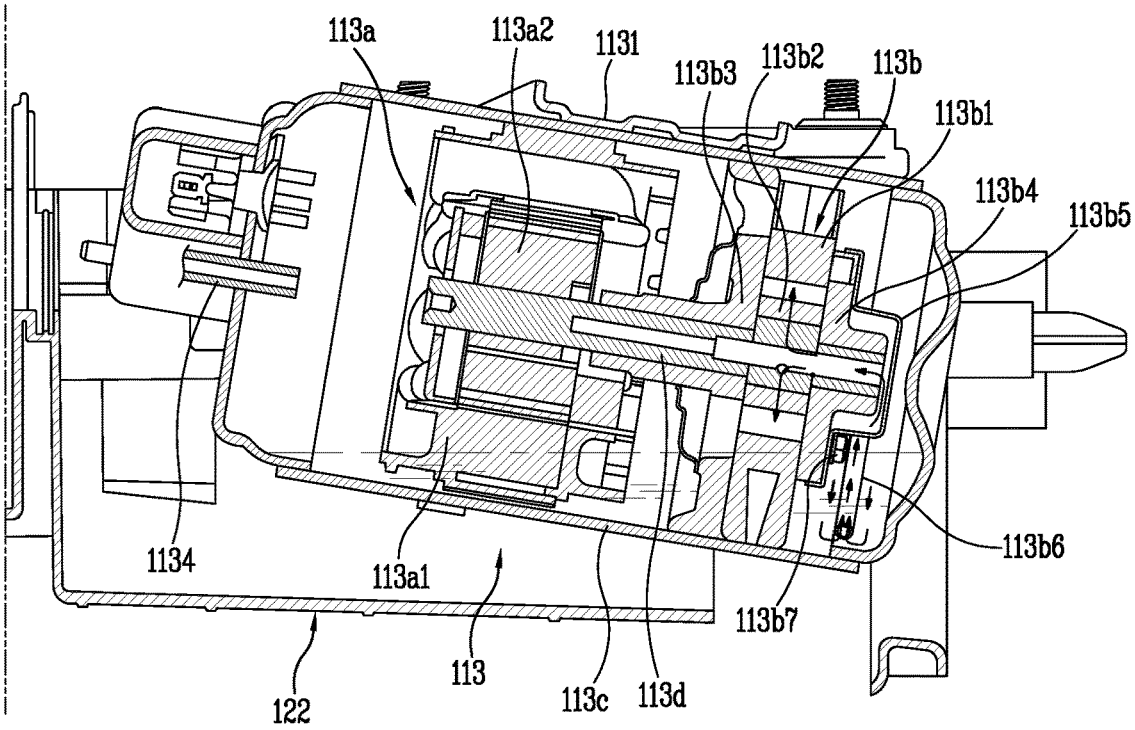
FIG. 8 is a cross-sectional view illustrating an internal structure of a compressor of FIG. 7.

According to the support structure of the compressor 113, vibration generated in the compressor 113 may be dispersed to four edge portions from the fixed portion of the bracket 1131 and transmitted to the four anti-vibration mounts 1132, and the anti-vibration mounts 1132 having a bellows tube shape may absorb the vibration. As illustrated in FIGS. 7 and 8, the horizontal compressor 113 may include the motor part 113a and the compression part 113b within the compressor casing 113c and may be substantially parallel to an installation surface.

The horizontal compressor 113 according to an embodiment of the present disclosure may be installed such that a rear portion of the compressor casing 113c is tilted downwardly with respect to a horizontal plane, whereby an oil intake hole for intaking oil to a sliding portion of the compression part 113b is immersed in oil. Accordingly, oil intaken through the oil intake hole may be smoothly supplied to the sliding portion of the compression part 113b. Also, a lower surface of the compressor base unit 122 may be tilted at a predetermined angle so as to be tapered at a predetermined angle. The tilt angle of the horizontal compressor 113 may be preferably 3° to 20° with respect to a horizontal line.

An internal structure of the horizontal compressor 113 will be described with reference to FIG. 8. The compressor 113 may include the compressor casing 113c filled with a predetermined amount of oil therein, the motor part (or motor) 113a provided in front of the compressor casing 113c and generating rotational force, a compression part 113b provided behind the compressor casing 113c and compressing a refrigerant, and an oil supply unit (or oil supply) supplying oil of the compressor casing 113c to the compression part 113b. The motor part 113a may include a stator 113a1 fixed to an inner wall of the compressor casing 113c and receiving power from the outside and a rotor 113a2 provided within the stator 113a1 by a predetermined air gap therebetween and rotating while interworking with the stator 113a1.

The compression part 113b may include a cylinder 113b1 installed within a casing, a main bearing 113b3 and a sub-bearing 113b4 covering both left and right sides of the cylinder 113b1, a rotational shaft 113d press-fit to the rotator 113a2 and supported by the main bearing 113b3 and the sub-bearing 113b4 to transmit rotational force, a rolling piston 113b2 rotatably coupled to an eccentric portion of the rotational shaft 113d and rotating in an internal space of the cylinder 113b1 to compress a refrigerant, and a vane coupled to the cylinder 113b1 so as to be movable in a radial direction and press-contact with an outer circumferential surface of the rolling piston 113b2 to demarcate an internal space of the cylinder 113b1 into a suction chamber and a compression chamber. The oil supply unit may include an oil cap 113b5 communicating with an end portion of an oil flow channel of the rotational shaft 113d, covering an outer surface of the sub-bearing 113b4, and having an oil accommodation space therein, an oil guide pipe 113b6 communicating with the oil cap 113b5, extending to a lower surface of the casing, and intaking oil of the lower surface of the casing to the oil cap 113b5, and an oil collecting pipe 113b7 communicating with a lower surface of the oil cap 113b5 and collecting oil to a lower surface of the casing.

Referring to an oil supply path of the compressor 113, when power is applied to the stator 113a1 of the motor part 113a, the rotor 113a2 may be rotated according to an interaction with the stator 113a1, and the rotational shaft 113d coupled to the rotor 113a2 may be rotated to transmit rotational force to the rolling piston 113b2 of the compression part 113b. As the rolling piston 113b2 eccentrically rotates in the internal space of the cylinder 113b1, a refrigerant may be sucked into the suction chamber of the cylinder 113b1, continuously compressed to predetermined pressure, moved to a high pressure portion of the casing, and subsequently moved to a heat pump cycle through an outlet 1134 formed on a front surface of the casing. Oil at a low pressure portion may be sucked to the oil cap 113b5 through the oil guide pipe 113b6, and the oil may move along an oil flow channel of the rotational shaft 113d and may be supplied between the rolling piston 113b2 as a sliding portion of the compression part 113b and the cylinder 113b1 through an oil hole, thus performing a lubricating operation.

If oil is not sufficiently supplied to the sliding portion of the compression part 113b, the sliding portion may be overheated due to frictional contact of the sliding portion and the operation of the compressor 113 may be stopped to protect the compressor 113. Thus, preferably, in order to allow oil to be sufficiently supplied to the sliding portion of the compression part 113b, the compressor 113 may be sloped at a predetermined angle such that the compression part 113b is positioned to be lower than the motor part 113a.

Hereinafter, a structure of the compressor base unit 122 supporting the compressor 113 will be described in detail with reference to FIGS. 9A through 9D. A compressor body 113 illustrated in FIG. 9A may be fixed by the bracket 1131, and supported by the compressor base unit 122.

The compressor body 113 may be accommodated within the compressor base unit 122, and may be installed such that an outer circumferential surface of the compressor body 113 is surrounded by the compressor base unit 122. The compressor base unit 122 may be integrally injection-molded together with the heat exchange duct unit 121.

The bracket 1131 may be provided in an upper portion of the compressor base unit 122 to cover the upper outer circumferential surface of the compressor body 113, and four edge portions of the bracket 1131 may be fastened to a support surface 1221*d* of the compressor base unit 122 by a fastening member 1133 such as a bolt, or the like.

The bracket 1131 may be a relatively thin and almost flat plate compared with the compressor body 113 or the compressor base unit 122. The bracket 1131 may be positioned in the upper portion of the compressor base unit 122 to make the compressor 113 compact.

The compressor body 113 may be accommodated in a horizontal direction between the upper portion of the tub 17 and the top cover 10*a* of the cabinet 10. A lower surface of the compressor body 113 may face an outer circumferential surface of the tub 17, and an upper surface of the compressor 113 may face the top cover 10, and thus, a space between the upper surface of the compressor body 113 and the top cover 10*a* is very narrow. As a result, it may be advantageous to provide a substantially flat bracket 1131.

The compressor body 113 may be arranged below the bracket 1131. Since a front end portion of the compressor body 113 may be sloped higher than a rear end portion thereof, the front end portion of the compressor body 113 may be slightly higher than the bracket 1131. However, the compressor body 113 may be mostly positioned blow the bracket 1131.

An upper outer circumferential surface of the compressor body 113 may be fixed to the fixed portion 1131*b* formed to be rounded in a middle portion of the bracket 1131 through 3-spot welding. The compressor body 113 may be fixed to the bracket 1131 and supported by the anti-vibration mount 1132 at an upper portion of the support 1221 formed on both sides of the compressor base unit 122, whereby vibration and noise generated by the compressor 113 may be minimized.

Figure 9A:
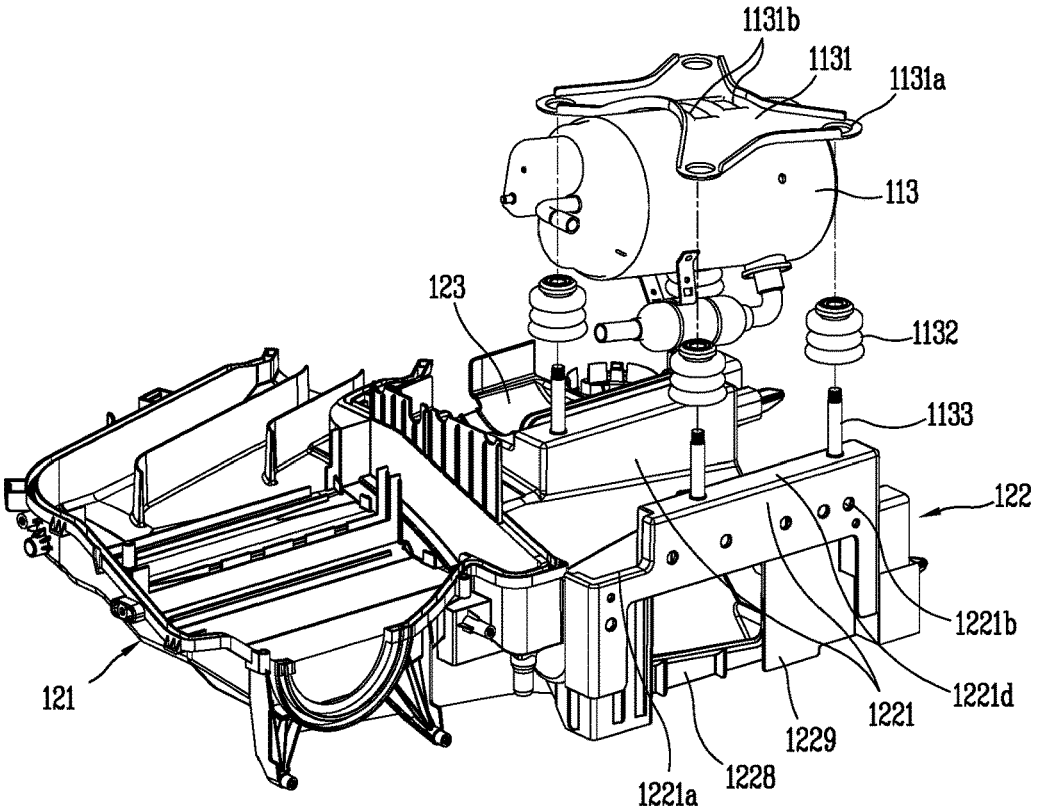
FIG. 9A is an exploded perspective view of a compressor installed in a compressor base unit according to an embodiment of the present disclosure.
Figure 9B:
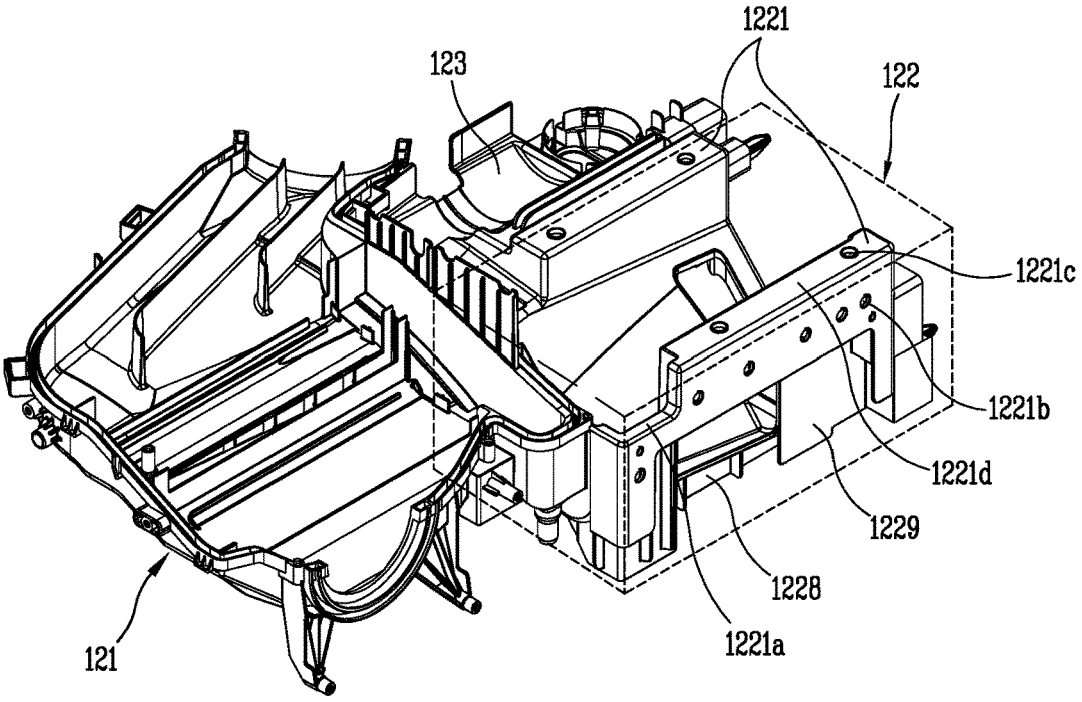
FIG. 9B is a perspective view of the compressor base unit of FIG. 9A.

A boundary of the compressor base unit 122 illustrated in FIG. 9B may be indicated by the dotted line having a hexahedral shape. The compressor base unit 122 may include supports 1221 supporting the compressor body 113 and a lower connection portion 1228 connecting lower end portions of the supports 1221. The compressor base unit 122 may have an accommodation portion for accommodating the compressor body 113, and the accommodation portion may be partitioned by the supports 1221 and the lower connection portion 1228. Both side surfaces and lower surface of the compressor body 113 may be surrounded by the supports 1221 and the lower connection portion 1228. An upper surface of the compressor body 113 may be surrounded by the bracket 1131.

Since the support 1221 should tolerate a load, it may have a predetermined thickness, and preferably, the support 1221 may have a dual-wall structure to maintain rigidity. The supports 1221 may face each other in a lateral direction with the compressor body 113 interposed therebetween.

A load of the compressor body 113 may be transmitted to an upper surface of the support 1221 in a gravitation direction, and thus, the load may be sufficiently tolerated by the dual-wall structure. In the dual-wall structure, an internal hollow portion may be surrounded by dual wall surfaces. A support surface 1221*d* may be formed in an upper portion of the support 1221, and the anti-vibration mount 1132 may be mounted on the support surface 1221*d*. The support surface 1221*d* may have a width allowing the anti-vibration mount 1132 to be supportedly mounted thereon. Two bolt holes 1221*c* may be formed on the support surface 1221*d*, and a fastening member 1133 such as a bolt may be inserted into the support 1221 in an upward direction.

A plurality of through holes 1221*b* may be formed on a side surface of the support 1221. An opening may be formed in a lower portion of the side surface of the support 1221. A side wall 1229 may be further formed on the side surface of the support 1221 and may be exposed through the opening in a lateral direction. An opening may also be formed on the side wall 1229 and a pipe or a suction pipe of the compressor 113 may be connected to a side surface or a lower surface of the compressor body 113 through the opening.

A cutaway portion 1221*a* may be formed on a front end portion and a rear end portion of the support 1221. By cutting out a portion unrelated to rigidity of the support 1221 through the cutaway portion 1221*a*, material cost may be reduced. In particular, a front end portion of the support 1221 may face the heat exchange duct unit 121, and a width of a horizontal surface and a vertical surface of the cutaway portion 1221*a* may be narrower than a width of the support surface 1221*d* of the support 1221. It may be preferable to reduce the width of the cutaway portion 1221*a* in order to secure a space for a pipe connecting the heat exchanger 110 and the compressor 113 extending from an upper portion of the cutaway portion 1221*a* to a lower surface of the compressor 113 by way of the inner side of the cutaway portion 12212*a*.

The lower connection portion 1228 may connect the support 1221 and cover a lower surface of the compressor body 113. The lower connection portion 1228 may not be in contact with the compressor body 113 and may not be loaded by the compressor body 113. The lower connection portion 1228 may be thin and may not be required to be configured as a dual-wall. In order to reduce material cost and obtain a compact configuration, the lower connection portion 1228 may have a small thickness. The lower connection portion 1228 may be sloped, may be angulated, or may be rounded to cover the lower surface of the compressor body 113 in a facing manner.

Figure 9C:
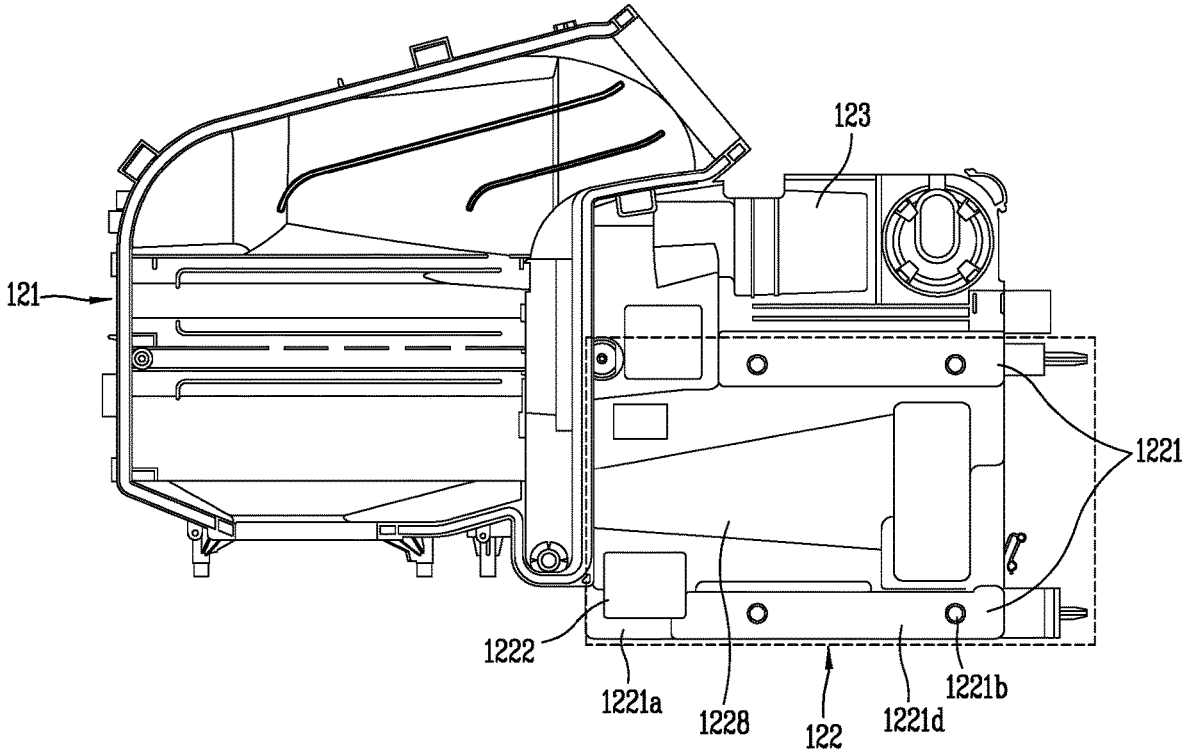
FIG. 9C is a plan view of the compressor base unit of FIG. 9B.

In the compressor base unit 122 illustrated in FIG. 9C, a plurality of through holes 1221*b* may be formed on the lower connection portion 1228. The through hole 1212*b* may have a quadrangular shape but is not limited thereto. The through hole 1221*b* may be compact and not interfere with the compressor base unit 122 and peripheral components (pipe, or the like).

Figure 9D:
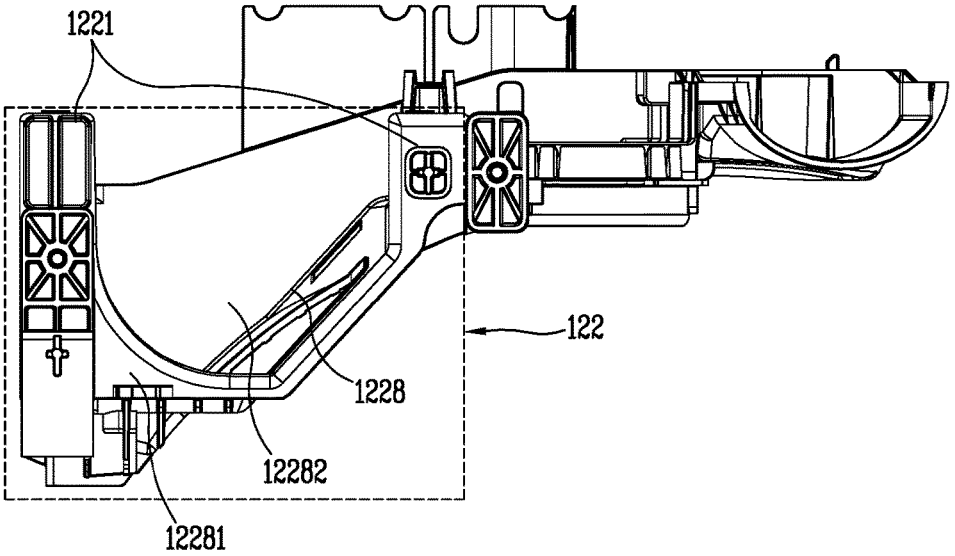
FIG. 9D is a rear view of the compressor base unit of FIG. 9C.
Figure 10:
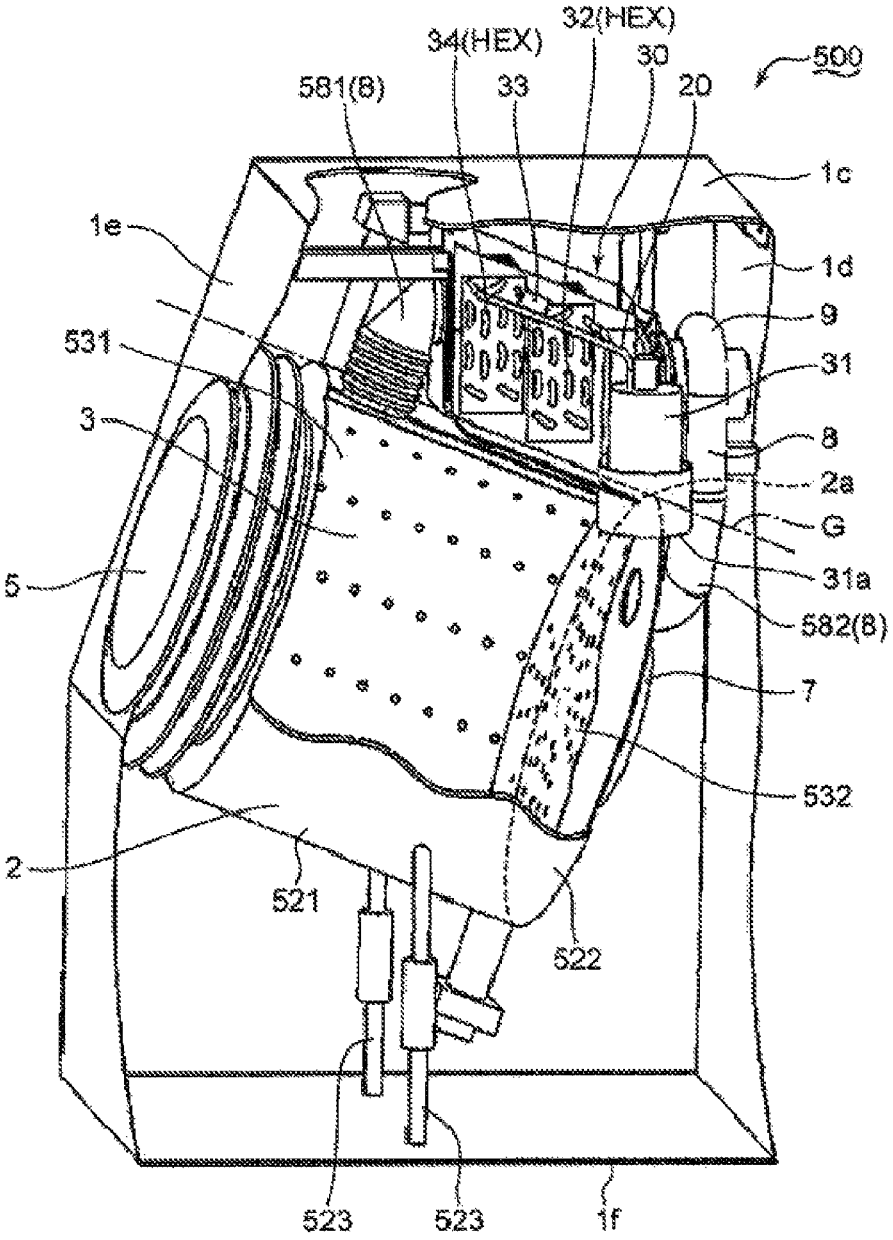
FIG. 10 RELATED ART
FIG. 10 is a cross-sectional view illustrating a configuration in which a heat pump system is provided above a tub in a dryer of the related art Patent document D1.

The compressor base unit 122 illustrated in FIG. 9D may have a partition 12282 forming a boundary with the heat exchange duct unit 121. The partition 12282 may be connected to the lower connection portion 1228 and a front end portion of the support 1221, and may extend in a direction perpendicular to the lower connection portion 1228 and the support 1221.

The compressor base unit 122 may be configured such that a rear surface facing a rear end portion of the compressor 113 is opened. The compressor base unit 122 may further include a reinforcing wall 12281 formed to protrude in an upward direction toward the compressor body 113 from the lower connection portion 1228. The reinforcing wall 12281 may connect the left support 1221 and the lower connection portion 1228 to reinforce rigidity between the support 1221 and the lower connection portion 1228. The reinforcing wall 12281 may be rounded to be concave in a left downward direction so that the compressor body 113 may pass over the reinforcing wall 12281.

The clothes treatment apparatus having the heat pump module 100 is not limited to the configurations and methods of the embodiments described above but the entirety or a portion of the embodiments may be selectively combined to be variously modified. Therefore, an aspect of the detailed description is to provide a clothes treatment apparatus capable of reducing vibration and noise of a compressor even though a compressor is positioned above a tub.

To achieve these and other advantages and in accordance with the purpose of this specification, as embodied and broadly described herein, a clothes treatment apparatus may include: a cabinet; a tub provided within the cabinet; a drum rotatably provided within the tub and configured to accommodate the laundry or a dry item therein; and a heat pump module configured to circulate a refrigerant through a compressor, a condenser, an expansion valve, and an evaporator, and re-circulate air discharged from the drum to the drum by way of the evaporator and the condenser, wherein the compressor is disposed above the tub, includes a compressor base unit configured to support a compressor body and a bracket disposed on an upper portion of the compressor base unit, and the compressor body is disposed below the bracket.

The compressor body may have a rotational shaft therein, and both end portions of the rotational shaft may be disposed in a horizontal direction to face a front side and a rear side of the cabinet. The bracket may be fixed to an upper portion of an outer circumferential surface of the compressor body by welding, and support the compressor body in a state of hanging on an upper portion of the compressor base unit.

The compressor body may be welded by three spots forming vertices of a triangle. The bracket may have a fixed portion formed to be rounded to surround a portion of an outer circumferential surface of the compressor body in a contact manner.

The compressor base unit may accommodate the compressor body therein. The compressor base unit may include: supports disposed to be spaced apart from each other with the compressor body interposed therebetween; and a lower connection portion connecting the supports.

The outer circumferential surface of the compressor body may be surrounded by the bracket, the supports, and the lower connection portion. The compressor base unit may include an anti-vibration mount disposed between the bracket and an upper surface of the support and configured to absorb vibration generated by the compressor.

The anti-vibration mount has a bellows shape, and absorbs vibrations in vertical, horizontal, and forward/backward directions generated by the compressor. The support may allow the anti-vibration mount to be mounted on an upper surface thereof to support a load of the compressor.

The compressor base unit may be supported by a back cover forming a rear surface of the cabinet in a backward direction. The compressor base unit may be disposed in a space between an upper side of the tub and a side corner of the cabinet.

To achieve these and other advantages and in accordance with the purpose of this specification, as embodied and broadly described herein, a clothes treatment apparatus may include: a cabinet; a tub provided within the cabinet; a drum rotatably provided within the tub and configured to accommodate the laundry or a dry item therein; and a horizontal compressor having a rotational shaft within a compressor body, the rotational shaft disposed to face a front side and a rear side of the cabinet, wherein the horizontal compressor is disposed such that the rotational shaft is downwardly sloped toward the rear side of the cabinet to allow oil to be collected to a sliding portion of a compression part.

The clothes treatment apparatus may further include: a heat pump module including an evaporator, a condenser, an expansion valve, and the horizontal compressor, configured to heat exchange a refrigerant and air discharged from a drum to supply hot air to the drum, wherein the heat pump module includes: a heat exchange duct unit configured to accommodate the evaporator and the condenser therein and connected to the tub to forma circulation flow channel for circulating air; and a compressor base unit integrally formed with the heat exchange duct unit, configured to surround an outer circumferential surface of the compressor body, and support the horizontal compressor installed therein.

The compressor base unit may have a support surface in an upper portion thereof and support the compressor body in a manner of hanging the compressor body on the support surface by using the bracket. The compressor base unit may have supports forming the support surface, surrounding an outer circumferential surface of the compressor body, and disposed to be spaced apart from each other in a facing manner.

A rear end portion of the support may be supported by a fastening member on a rear side of the cabinet. The compressor body may be disposed below the bracket. The compressor body may have an outlet in a direction facing the heat exchange duct unit.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the scope of the disclosure will become apparent to those skilled in the art from the detailed description.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothes treatment apparatus comprising:
a cabinet;
a tub provided within the cabinet;
a drum rotatably provided within the tub and configured to accommodate laundry therein; and
a compressor provided above a top portion of the tub, the compressor including a compressor body and an outlet formed in the compressor body.

2. The clothes treatment apparatus of claim 1, wherein the compressor body is disposed such that a central line parallel to an outer circumferential surface is upwardly sloped toward the outlet with respect to a horizontal plane.

3. The clothes treatment apparatus of claim 1, wherein the compressor comprises:
a compressor base configured to support the compressor body;
a bracket fixing the compressor body; and
a plurality of anti-vibration mounts between the bracket and the compressor base,
wherein the bracket and the anti-vibration mounts are mounted on an upper portion of the compressor base to support the compressor body in a state of hanging on the upper portion of the compressor base.

4. The clothes treatment apparatus of claim 1, further comprising a heat pump configured to circulate a refrigerant through the compressor, a condenser, an expansion valve, and an evaporator, and re-circulate air discharged from the drum to the drum by way of the evaporator and the condenser.

5. The clothes treatment apparatus of claim 4, wherein the outlet faces a heat exchange duct which accommodates the evaporator and the condenser.

6. The clothes treatment apparatus of claim 1, wherein the compressor body has a rotational shaft therein, and both end portions of the rotational shaft are arranged in a horizontal direction to face a front side and a rear side of the cabinet.

7. The clothes treatment apparatus of claim 3, wherein the bracket has a fixed portion formed to be rounded to surround a portion of an outer circumferential surface of the compressor body in a contact manner.

8. The clothes treatment apparatus of claim 3, wherein the compressor base includes:
supports provided spaced apart from each other with the compressor body interposed therebetween; and
a lower connection portion connecting the supports.

9. The clothes treatment apparatus of claim 8, wherein the outer circumferential surface of the compressor body is surrounded by the bracket, the supports, and the lower connection portion.

10. The clothes treatment apparatus of claim 3, wherein the plurality of anti-vibration mounts are provided between the bracket and an upper surface of the supports and configured to absorb vibration generated by the compressor.

11. The clothes treatment apparatus of claim 3, wherein each of the plurality of anti-vibration mounts has a bellows shape, and is configured to absorb vibrations in vertical, horizontal, and forward/backward directions generated by the compressor.

12. The clothes treatment apparatus of claim 3, wherein the compressor base is supported by a back cover forming a rear surface of the cabinet in a backward direction.

13. The clothes treatment apparatus of claim 3, wherein the compressor base is provided in a space between an upper side of the tub and a side corner of the cabinet.

14. The clothes treatment apparatus of claim 1, further including:
a heat pump including an evaporator;
a condenser; and
an expansion valve, wherein the compressor is configured to heat exchange a refrigerant and air discharged from a drum to supply hot air to the drum, and wherein the heat pump includes:
a heat exchange duct configured to accommodate the evaporator and the condenser therein and connected to the tub to form a circulation flow channel for circulating air; and
a compressor base integrally formed with the heat exchange duct and configured to surround an outer circumferential surface of the compressor body and support the compressor body.

15. The clothes treatment apparatus of claim 8, wherein a rear end portion of each of the supports is supported by a fastener on a rear side of the cabinet.

16. The clothes treatment apparatus of claim 3, wherein the compressor body is provided below the bracket.

17. A clothes treatment apparatus, comprising:
a cabinet;
a tub provided within the cabinet;
a drum rotatably provided within the tub and configured to accommodate laundry therein, wherein the drum rotates around an axis extending in a first direction
a compressor including a rotational shaft extending in a second direction, wherein the second direction is less than 90 degrees from the first direction and is not parallel to a gravitational direction.

18. The clothes treatment apparatus of claim 17, wherein the compressor is provided above the tub.

19. The clothes treatment apparatus of claim 18, wherein the first direction is a direction perpendicular to the gravitational direction.

* * * * *